US005746685A

United States Patent [19]

Glaser

[11] Patent Number: 5,746,685

[45] Date of Patent: May 5, 1998

[54] WRIST MEMORY STRAP TO ASSIST POWERLIFTING

[76] Inventor: Mark Leonard Glaser, 8903 Arley Dr., Springfield, Va. 22153-1504

[21] Appl. No.: 840,634

[22] Filed: Apr. 25, 1997

[51] Int. Cl.[6] ..... A63B 21/00; A41D 19/00

[52] U.S. Cl. ..... 482/93; 2/161.1; 224/219; 294/25; 294/156

[58] Field of Search ..... 482/23, 92, 93, 482/105, 106, 139; 2/161.1, 170; 224/219, 221, 222; 294/25, 74, 149, 150, 156; 24/17 B, 442

[56] References Cited

U.S. PATENT DOCUMENTS 5,324,244 6/1994 Miller et al. ..... 482/106
5,557,805 9/1996 Emerson ..... 2/161.1 X

FOREIGN PATENT DOCUMENTS 1050789 12/1966 United Kingdom ..... 294/74

OTHER PUBLICATIONS

Lift-All Company, Inc. "TRX-Coated Nylon Web Slings" (Advertisment) Jun. 1973.

*Primary Examiner*—Richard J. Apley
*Assistant Examiner*—John Mulcahy
*Attorney, Agent, or Firm*—H. Jay Spiegel

[57] ABSTRACT

A strap is made of a flexible material such as cotton or NYLON and includes a loop at one end large enough to allow the other end of the strap to be slipped through the loop to provide a strap portion that may encircle the wrist of the user. The other end of the strap has a rigid ring attached to it and the body of the strap has a thin, stiff wire embedded in it. The strap portion may be encircled about the wrist of the user and the other end of the strap may be wrapped once about a barbell bar. The rigidity of the strap imparted to it by the thin, stiff wire allows the end of the strap with the rigid ring to be maintained in an upward direction so that a finger of the user may be slipped through the ring and used to tighten the strap about the bar.

12 Claims, 2 Drawing Sheets

WRIST MEMORY STRAP TO ASSIST POWERLIFTING

BACKGROUND OF THE INVENTION

The present invention relates to a wrist memory strap to assist powerlifting. In the prior art, straps and other appliances used in facilitating enhanced gripping are known. Applicant is aware of the following United States Patents:

U.S. Pat. No. 3,541,990 to Du Mas

U.S. Pat. No. 4,487,412 to Meeko

U.S. Pat. No. 4,809,974 to Buhr

U.S. Pat. No. 5,324,244 to Miller et al.

U.S. Pat. No. 5,350,343 to DaSilva

U.S. Pat. No. 5,353,440 to Meldeau.

None of these references teaches all of the features and aspects of the present invention, particularly the combination of an elongated strap having a rigidifying wire embedded therein with a loop at one end and a ring at the other end.

SUMMARY OF THE INVENTION

The present invention relates to a wrist memory strap to assist powerlifting. The present invention includes the following interrelated objects, aspects and features:

(1) In a first aspect, the present invention consists of an elongated strap having a first end and a second end. At the first end of the strap, the strap is folded upon itself and stitched to form a loop. The loop defines a large enough opening to allow the second end of the strap to be inserted through the loop and pulled tight to provide a strap portion that may be used to encircle the wrist of the user.

(2) The second end of the strap has a rigid ring attached thereto. The rigid ring may be made of any suitable material such as, for example, wood, plastic, or metal. In the preferred embodiment, the rigid ring is made of a triangular shape preferably, a rounded corner triangular ring. Of course, a "D"-shaped ring, a square-shaped or rectangularly-shaped ring may also be employed.

(3) The elongated strap has a thin, stiff wire embedded therein that imparts a degree of rigidity to the strap.

(4) The second end of the strap may be inserted through the loop in the first end thereof and may be pulled tight with the wrist of the user extending through the strap portion defined thereby. The second end of the strap may be wrapped once around a barbell bar with the thin, stiff wire embedded within the strap body being useful to facilitate the second end of the strap holding a position slightly uplifted. Of course, if the thin, stiff wire were not embedded within the strap body, the second end of the strap would merely hang limply in a downward direction. However, due to the existence of the thin, stiff wire, the second end of the strap remains in a position whereby a finger of the user may be inserted through the rigid ring to facilitate manipulation of the second end of the strap to allow tightening of the strap about the barbell bar while the strap portion of the strap is tightly encircling the wrist of the user. In this way, a barbell bar may be securely gripped during weightlifting.

As such, it is a first object of the present invention to provide a wrist memory strap to assist powerlifting.

It is a further object of the present invention to provide such a device wherein a first end of the strap is folded upon itself and stitched to form a loop.

It is a further object of the present invention to provide such a device wherein the second end of the strap may be extended through the loop and tightened to form a strap portion that may be encircled about the wrist of the user.

It is a yet further object of the present invention to provide such a device wherein a thin, stiff wire is embedded within the strap body to impart rigidity to the strap allowing the rigid ring thereof to be easily gripped by the user to tighten the strap about a barbell bar.

These and other objects, aspects, and features of the present invention will be better understood from the following detailed description of the preferred embodiment when read in conjunction with the appended drawing figures.

SPECIFIC DESCRIPTION OF THE PREFERRED EMBODIMENT

Figure 4:
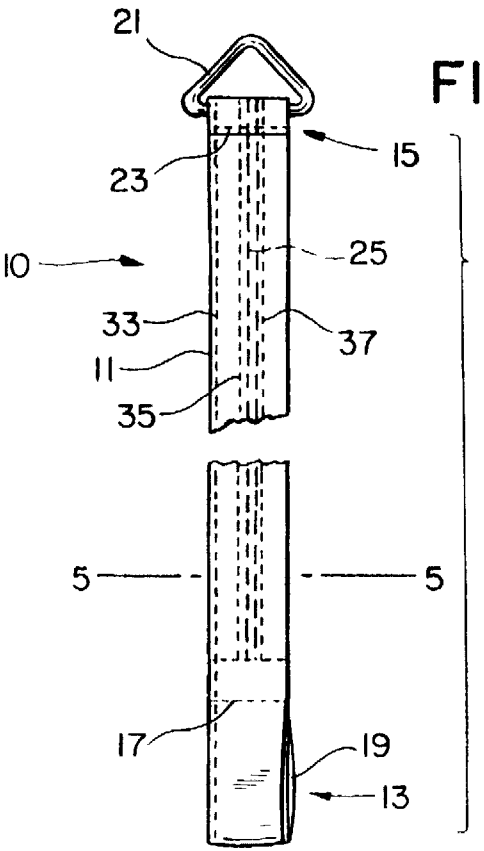
FIG. 4 shows a front view of the strap as it appears before use.
Figure 5:
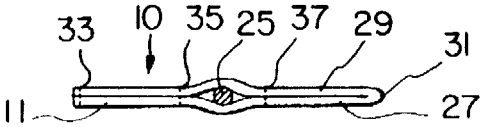
FIG. 5 shows a cross-sectional view along the line 5—5 of FIG. 4.

With reference, first, to FIGS. 4 and 5, the inventive strap is generally designated by the reference numeral 10 and is seen to include a body 11 having a first end 13 and a second end 15. As seen in FIG. 4, the first end 13 is folded upon itself and stitched at 17 to form a loop 19.

With further reference to FIG. 4, the second end 15 of the strap 10 includes a rigid ring 21 shown having a generally triangular configuration. Preferably, the ring 21 comprises a rounded corner triangular ring. If desired, however, the rigid ring 21 may take on a D-shaped configuration, a square or rectangularly-shaped configuration. The ring 21 may be made of any suitable rigid material such as plastic, wood, or metal. In order to secure the ring 21 at the second end 15 of the strap 10, the end of the strap body 11 is folded upon itself and stitched at 23 to capture one side of the ring 21.

With reference to FIGS. 4 and 5, a thin, stiff wire 25 is embedded within the body 11 parallel to the longitudinal extent thereof. As seen in FIG. 5, the body 11 is formed by the portions 27 and 29 folded at the crease 31 and stitched together at the stitching 33 to form the body 11. The wire 25 is placed between the portions 27 and 29 and the two parallel stitchings 35 and 37 (FIG. 4) capture the wire 25 in the position shown. The wire 25 may be made of any suitable steel, particularly a grade of steel or metal that allows bending upon force application and maintenance of a bent shape.

Figure 2:
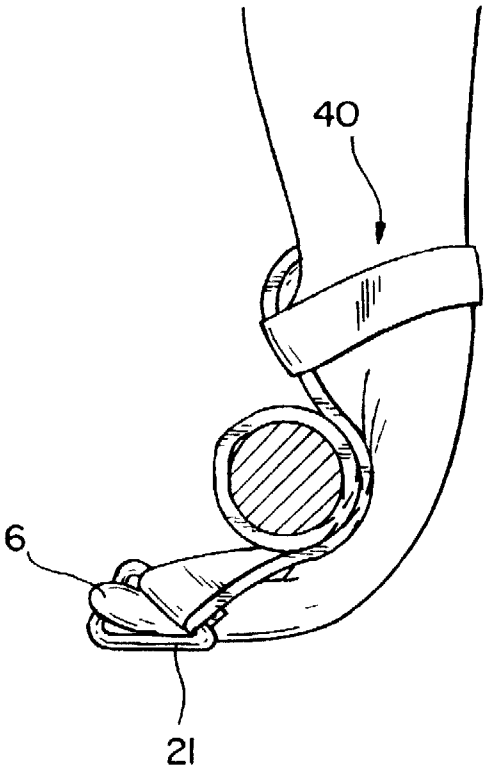
FIG. 2 shows a side view of the present invention with a finger of the user extending through the rigid ring portion thereof to tighten the strap about a barbell bar.
Figure 1:
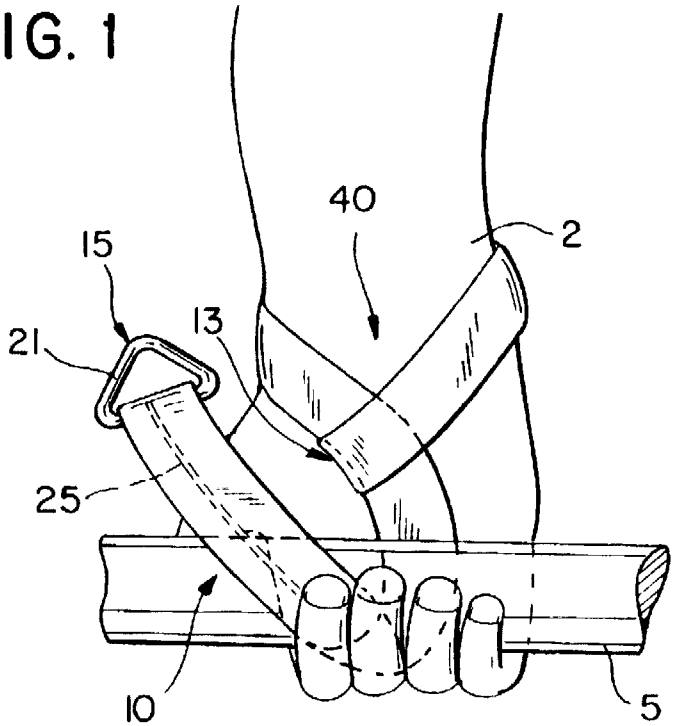
FIG. 1 shows a front view of the present invention in a first position of installation.
Figure 3:
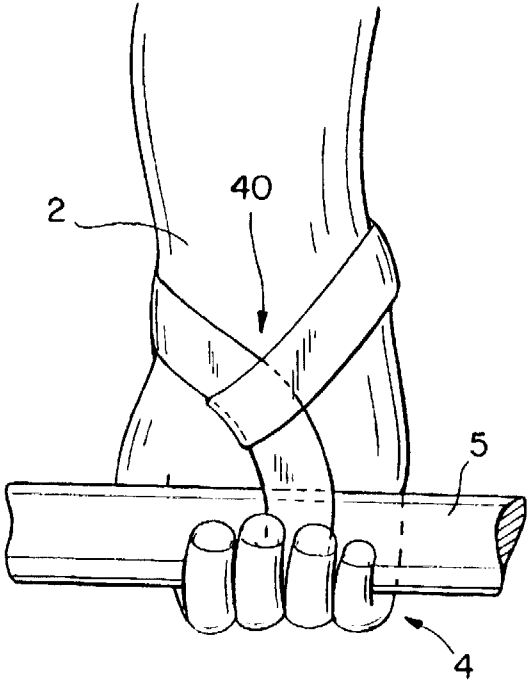
FIG. 3 shows a front view of the present invention with the strap installed in its final position.

With reference to FIGS. 1–3, it is seen that the second end 15 of the strap body 11 may be inserted through the loop 19 to form a strap portion 40 that may encircle the wrist 2 of the user. In the position shown in FIG. 1, the second end 15 of the strap 10 has been placed under the barbell bar 5 and through the stiffness of the wire 25, the ring 21 is maintained in an upward position.

The strap 10 is then wound or wrapped one revolution about the bar 5 to the position shown in FIG. 2 wherein the finger 6 of the user may be extended through the ring 21 to allow tightening of the strap 10 about the bar 5 to the position shown in FIG. 3 with the hand 4 of the user gripping over the portion of the strap that has been wrapped about the bar 5 to provide a firm grip of the bar 5 when weightlifting.

In the preferred embodiment of the present invention, the body 11 of the strap 10 is made of any suitable material such as cotton or nylon. In the preferred embodiment, the wire 25 is preferably made from 0.001 inches to 0.01 inches in thickness and from 8 to 12 inches in length. Of course, these dimensions are to be considered merely exemplary.

Accordingly, an invention has been described in terms of a preferred embodiment thereof which fulfills each and every one of the objects of the invention as set forth hereinabove and provides a new and useful wrist memory strap to assist powerlifting of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. A strap for assisting a user in gripping a bar, comprising:

a) an elongated flexible body having a first end and a second end;

b) said first end having a loop;

c) said second end having a ring attached thereto, said loop being large enough to permit said second end including said ring to pulled therethrough; and d) an elongated thin stiff wire in said elongated body along the length thereof for imparting rigidity to the elongated body.

2. The strap of claim 1, wherein said ring has a triangular shape.

3. The strap of claim 2, wherein said ring comprises a rounded corner triangular ring.

4. The strap of claim 1, wherein said ring is made of metal.

5. The strap of claim 1, wherein said body is made of a piece of fabric including two portions formed by folding said piece at a seam and stitching open edges of said portions together.

6. The strap of claim 5, wherein said wire is captured between said pieces.

7. The strap of claim 1, wherein said wire is made of metal.

8. A method of enhancing grip of a barbell bar by a user while weightlifting, including the steps of:

a) providing a strap including:

i) an elongated flexible body having a first end and a second end;

ii) said first end having a loop;

iii) said second end having a ring attached thereto, said loop being large enough to permit said second end including said ring to be pulled therethrough; and iv) an elongated thin stiff wire in said body along a direction of extension thereof;

b) pulling said second end of said strap through said loop to create a strap portion;

c) encircling a wrist of a user with said strap portion;

d) tightening said strap portion about a wrist;

e) wrapping said body about a bar, said wire causing said second end of said strap to extend upwardly;

f) inserting a finger through said ring; and g) tightening said strap about said bar.

9. The method of claim 8, wherein said wrapping step includes the step of wrapping said body one revolution about said bar.

10. The method of claim 9, further including the step of gripping said bar over said revolution of said strap.

11. The method of claim 8, wherein said ring has a triangular shape.

12. The method of claim 8, wherein said wire is made of metal.

* * * * *